US005141251A

United States Patent [19]

Smith

[11] Patent Number: 5,141,251

[45] Date of Patent: Aug. 25, 1992

[54] SKI POLE CLIP ATTACHMENT TO SKIS FOR CARRYING

[76] Inventor: Herbert R. Smith, 38 Sasco Hill Terrace, Fairfield, Conn. 06430

[21] Appl. No.: 651,292

[22] Filed: Feb. 5, 1991

Related U.S. Application Data

[63] Continuation-in-part of Ser. No. 554,903, Jul. 20, 1990, abandoned.

[51] Int. Cl.[5] ..... A63C 11/02

[52] U.S. Cl. ..... 280/814; 224/917; 294/147

[58] Field of Search ..... 280/814, 816, 419, 820, 280/809; 224/185, 270, 917; 294/15, 143, 147; 403/334, 397, 391, 405.1; 24/563, 336, 543

[56] References Cited

U.S. PATENT DOCUMENTS

| | | | |
|---|---|---|---|
| 4,002,349 | 1/1977 | Dopp | 280/814 |
| 4,620,722 | 11/1986 | Dann | 280/814 |
| 4,630,842 | 12/1986 | Roda | 280/814 |
| 4,702,495 | 10/1987 | Roda | 280/814 |
| 4,861,072 | 8/1989 | Humphrey | 280/814 |

*Primary Examiner*—Andres Kashnikow
*Assistant Examiner*—Richard Camby
*Attorney, Agent, or Firm*—Frank J. Thompson

[57] ABSTRACT

An improved snow ski support arrangement is disclosed which uses a generally U-shaped, resilient clip body mounted to a snow ski for engaging a ski-pole. The clip body is mounted to a ski and is configured to receive and engage a ski pole. In a particular arrangement, the clip body is configured to receive and engage a ski pole in one of two alternate positions.

18 Claims, 3 Drawing Sheets

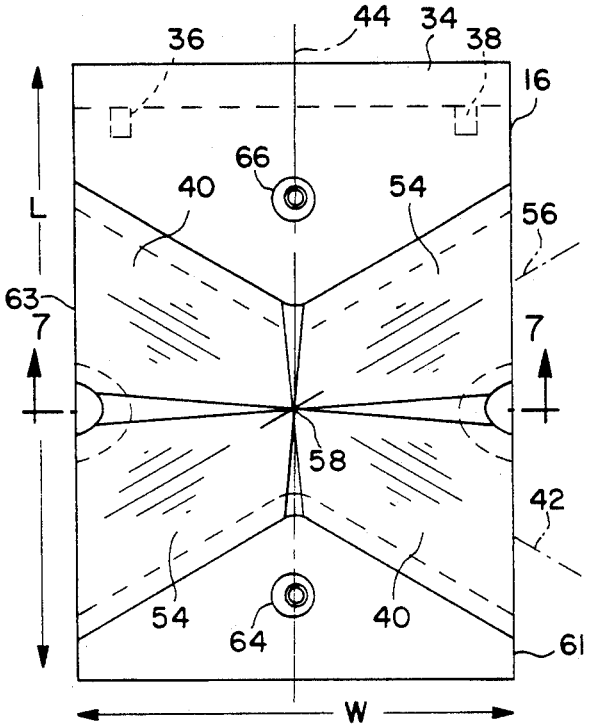
FIG. 3
FIG. 5
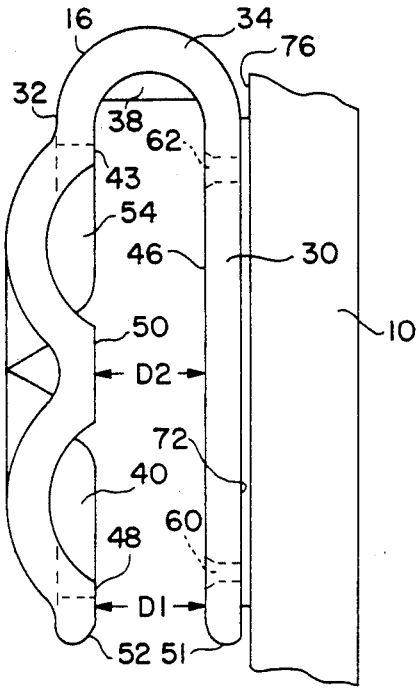
FIG. 6
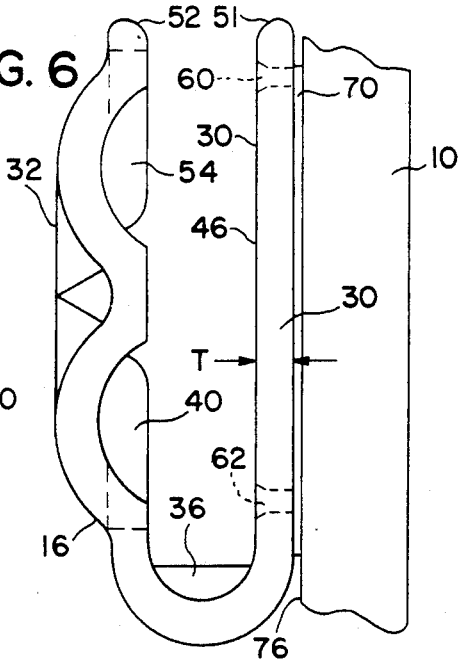
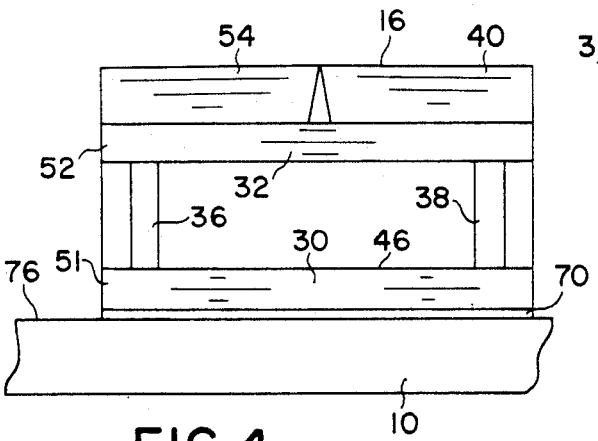
FIG. 4

SKI POLE CLIP ATTACHMENT TO SKIS FOR CARRYING

BACKGROUND OF THE INVENTION

Field of the Invention

This invention relates to an improved arrangement for supporting skis. The invention relates more particularly to an improved arrangement for supporting snow skis during transport.

Description of the Prior Art

This is a continuation-in-part application of my copending U.S. patent application Ser. No. 07/554,903 filed on Jul. 20, 1990 now abandoned and entitled "Ski and Pole Carrying Device".

The transport from location to location of snow ski equipment including a pair of snow skis and a pair of ski poles is known to be relatively cumbersome. A number of devices have been provided in an attempt to facilitate this carriage. In one arrangement a means is provided which engages both the skis and the poles and provides a handle for carrying the skis alone or the skis and poles in a combined, temporary assembly. Another technique known in the prior art is described in U.S. Pat. No. 4,630,842 and in U.S. Pat. No. 4,702,495. This technique provides a receiving means mounted on the ski for receiving and engaging a ski pole tip thus constituting the ski pole as a carrying implement. When the ski pole is positioned on one's shoulder, this temporary assembly provides for transport of the skis.

SUMMARY OF THE INVENTION

It is an object of this invention to provide an improved arrangement for supporting a ski.

Another object of the invention is to provide an improved arrangement for transporting a snow ski.

Another object of the invention is to provide an improved arrangement for transporting a snow ski using a ski pole as a support or gripping body.

A further object of the invention is to provide an improved arrangement for carrying a snow ski with the aid of a ski pole.

Still another object of the invention is to provide an improved arrangement for carrying a pair of snow skis with a pair of ski poles positioned.

In accordance with features of the invention, an improved arrangement for supporting a snow ski comprises a generally U-shaped clip body having an integral end member and first and second integral leg members extending from the end member. The clip body is formed of a material and is configured to provide for resilient deflection of a leg member for receiving and captivating a snow ski support body between the leg members. A means is also provided for mounting the clip body to the ski at the first leg member.

In accordance with other features of the invention, the second leg member includes an integral shaped segment which conforms in part with the cross sectional configuration of a captivated ski support body. The ski support body enters the clip body from without at one side of the clip body, extends through the clip body between the leg members where it is captivated at the shaped segment and extends from the clip body at an opposite side thereof. The clip body has a longitudinal axis and the shaped segment extends transversely to the longitudinal axis.

In accordance with further features of the invention, the second leg member includes first and second shaped segments each shaped to conform in part with a cross section of a support body. Each shaped segment has a longitudinal axis. The axes of these shaped segments intersect and extend transversely to the clip body's longitudinal axis. When each of a pair of clip bodies is mounted to each of a pair of skis, the skis are positioned back-to-back as is usually done and each of a pair of ski poles is inserted in the clip bodies, the skis can be carried behind the skier with the ski poles on the skier's shoulder, with the skis on the skier's shoulder with the poles acting as a grip or at an intermediate attitude of the skis and poles.

BRIEF DESCRIPTION OF THE DRAWINGS

These and other features and objects of the invention will become apparent with reference to the following specification and to the drawings, wherein:

FIG. 3 is an enlarged top plan view of the clip body of this invention;

FIG. 4 is a front elevation view of the clip body of FIG. 3 modified to include a fragmentary view of a ski to which it is mounted;

FIG. 5 is a right side elevation view of the clip body of FIG. 3 modified to include a fragmentary view of a ski to which it is mounted;

FIG. 6 is a left side elevation view of the clip body of FIG. 3 modified to include a fragmentary view of a ski to which it is mounted;

DETAILED DESCRIPTION

Figure 1:
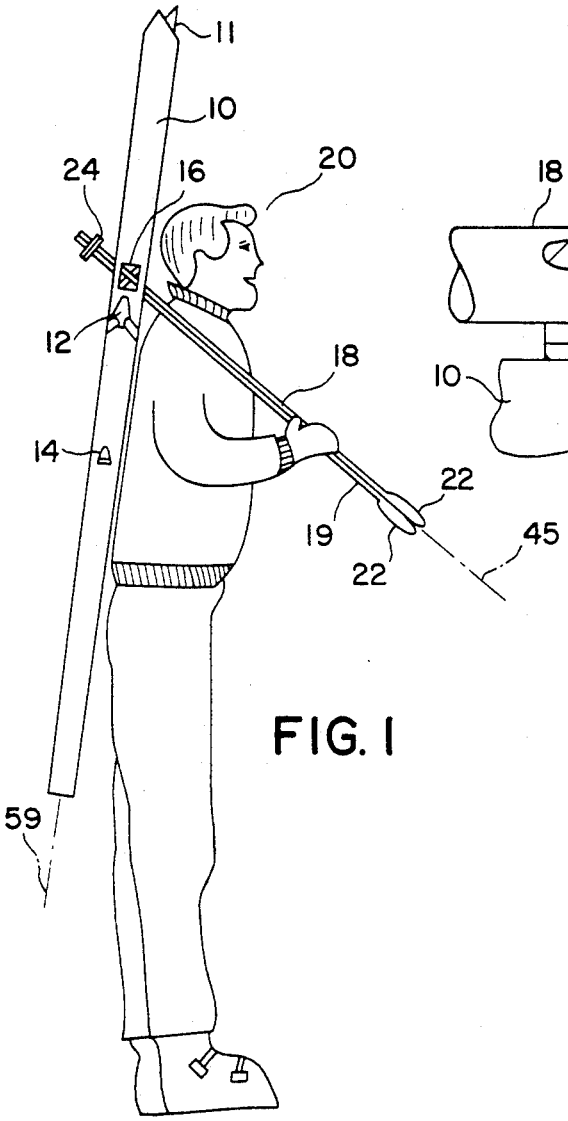
FIG. 1 is a side, schematic view illustrating a skier supporting a back-to-back assembly of skis with the arrangement of this invention.
Figure 7:
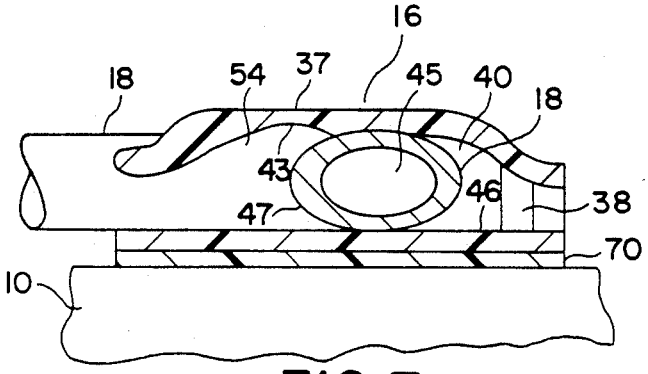
FIG. 7 is a fragmentary view, partly in section, taken along line 7—7 of FIG. 3 and modified to include a fragmentary view of a ski to which it is mounted and to illustrate the positioning of a ski pole in the clip body.
Figure 2:
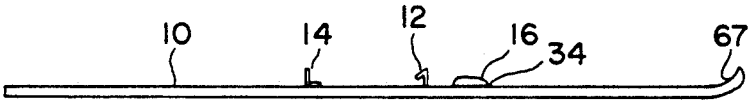
FIG. 2 is a side elevation view of a snow ski of FIG. 1 illustrating the clip body of this invention mounted thereto.

Referring now to the drawings and particularly to FIGS. 1 and 2, a skier 20 is shown carrying a back-to-back assembly of a pair of elongated snow skis 10 and 11. The skis 10, 11 are maintained in this assembly by conventional means, not illustrated, such as straps or ski brake. Each ski includes a ski boot binding assembly having toe and heel binding members 12 and 14, respectively mounted thereto. Each ski 10, 11 also includes a generally U-shaped clip body 16 of this invention mounted to the ski at a location forward of the toe ski binding body 12. As described in greater detail hereinafter, ski support bodies comprising a pair of ski poles 18 and 19, each of which is adapted to engage and be captivated by a clip body 16, provide for support of and for transport of the skis on the shoulder of the skier 20. It will be observed that the ski pole support bodies 18 and 19 are captivated by the clip body 16 at a location on the support body between a handle segment 22 and a basket member 24. A basket member 24 is mounted to each ski pole support body 18, 19 in a manner well known to the art for inhibiting deep penetration of the ski pole into snow.

The clip body 16 which is shown in greater detail in FIGS. 3-7 comprises a generally U-shaped body having a first integral leg member 30, a second integral leg member 32 and an integral end member 34. Clip body 16 is fabricated from a weather resistant material which provides resilient deflection of the leg members 30 and 32. Resilient deflection as used in this specification and the appended claims means that the leg members 30 and 32 can be squeezed together or expanded apart from their rest position of FIGS. 4, 5 and 6 and when the squeezing or expanding force is removed, the leg members will return to their rest position. Weather resistant materials include polymer plastics and metals. Suitable polymer plastics include injection molded reinforced nylon and injection molded reinforced thermoplastic resins. One such suitable nylon material comprises glass fiber reinforced nylon available from the Monsanto Chemical Company of St. Louis, Mo. under the trade name VYDYNE®R. A suitable thermoplastic resin comprises a glass fiber reinforced thermoplastic resin available from the General Electric Company of Pittsfield, Ma. under the trade name Xenoy® 6380. A suitable metal is stainless steel. The clip body 16 has a length L as illustrated in FIG. 3 by the letter L, a width W as illustrated in FIG. 3 by the letter W and a substantially uniform thickness as illustrated by the letter T in FIG. 6 includes reinforcing ribs 36 and 38 which are integrally formed with the end member 34.

Figure 8:
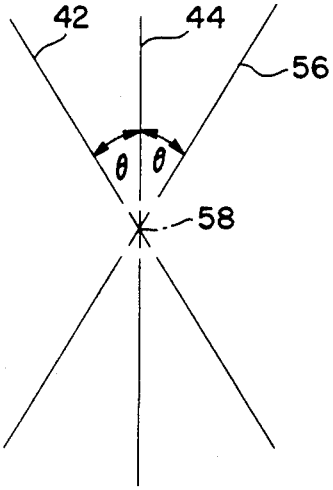
FIG. 8 is a diagram illustrating angular relationships between various axes of the clip body of FIG. 3.

The second leg member 32 is formed to include an integral shaped segment which conforms at least in part with a cross sectional configuration of a support body 18, 19 positioned in the clip body 16. The shaped segment can be formed to have any of a number of different shapes which conform in part with that of the support body. The support body's cross sectional configuration while preferably circular can, for example, also have other various geometrical shapes as for example oval, hexagonal, triangular, rectangular or square. A first elongated shaped segment 40 (FIG. 3) is formed along its length to conform in part with a generally circular, outer surface, cross-section of a tubular ski pole. Shaped segment 40 has a circular arc shaped configuration which conforms in part with the circular cross section of the outer surface of the ski pole support body 18, 19. Shaped segment 40 is shown to have a longitudinal axis 42 which extends in a direction transverse to a longitudinal axis 44 of the clip body and forms an angle $\theta$ (FIG. 8) therewith. The length of arcuate shaped segment 40 extends between the sides 61 and 63 of the leg member 32. An axis 45 of the support body ski pole extends parallel to the shaped segment's longitudinal axis 42 and the outer surface 47 of the ski pole (FIG. 7) is in surface contact engagement with an inner surface 43 of the leg member 32 and the inner surface 46 of leg member 30. The support body 18, 19 will have a cross sectional dimension greater in size than the distances D1 and D2 between a surface 46 of the first leg member 30 and flats 48 and 50, respectively on the inner surface 43 of the second leg member 32. Entry of the ski pole support body 18, 19 into the clip body 16 is accomplished by positioning the length of the support body 18, 19 adjacent the distal edges 51 and 52 of the leg members 30 and 32, respectively and applying a manual force to the support body 18, 19 in the direction of the clip body's longitudinal axis 44. This causes contact with and resilient deflection of the second leg member 32 away from the first leg member 30. Upon entry and positioning of the support body 18, 19 in the shaped segment 40, the tensioned leg member 32 will apply a restraining force to the ski pole support body which is positioned nested and captivated by the clip body 16 in the shaped segment 40. When so positioned, the ski pole support body 18 enters the clip body 16 from without the body 16 at a first side 61, extends through the clip body 16 and exits from the clip body at a second side 63 thereof. Removal of the support body ski pole 18, 19 is accomplished by applying a withdrawal force to the support body 18, 19 in an opposite direction along the clip body's axis 44 thus forcing the leg member 32 to deflect outward slightly from the leg member 30 as the support body is withdrawn.

Similarly, a second shaped segment 54 is integrally formed in the leg member 32. Shaped segment 54 is also configured to conform at least in part with the cross sectional configuration of a support body as described hereinbefore. Shaped segment 54 which is arcuate shaped extends between sides 61 and 63 of the clip body 16 and has a longitudinal axis 56 which extends transverse to and intersects the clip body's longitudinal axis 44. It also intersects the longitudinal axis 42 of the first shaped segment 40 at a central location 58 on the leg member 32. By providing a clip body with first and second shaped segments 40 and 54 respectively, the clip body 16 can be mounted on each ski of a pair of skis, the skis can be orientated in a back-to-back relationship as is common and each ski pole of a pair can be positioned in one of the clip bodies at the same angle.

While variations may be made thereto, it is preferable that the shaped segments 40 and 54 are arranged for providing that when the clip body 16 is mounted to a ski, the longitudinal axis 44 is substantially parallel to a longitudinal axis 59 of a ski 10 (FIG. 1). A ski can then be transported with the ski pole supported on the user's shoulder at a comfortable angle, the ski can be supported on the skier's shoulder and the ski pole functions as a convenient grip or both ski and ski pole are supported on the user's shoulder. The clip body 16 functions in part as a union to enable the skier to adjust the assembly of ski and ski pole to a comfortable attitude and position. By forming the clip to provide an angle $\theta$ (FIG. 8) in the range of about 55° to about 65° and positioning the longitudinal axis 44 of the clip body 16 substantially parallel to the longitudinal axis 59 of the ski, this desired relationship can be established.

As indicated hereinbefore, the clip body 16 is mounted to the ski 10 at a position forward of the toe binding 12. The clip body 16 is orientated on the ski 10 to provide that the clip body end member 34 faces toward a front end 67 of the ski. Clip body 16 can be mounted by a suitable adhesive or by a mechanical means. Mounting by a mechanical means is accomplished with screws. Countersunk apertures 60 and 62 for receiving screws are formed in the first leg member 30. Tool access apertures 64 and 66 are also provided in the leg member 32 and are aligned with the countersunk apertures. Alternatively, the clip body 16 is mounted by an adhesive such as an epoxy resin or by a double coated adhesive transfer tape 70, as is illustrated in FIGS. 3-6. One such adhesive tape is available from the 3M Industrial Specialties Division of St. Paul, Mn. and comprises a double coated acrylic foam tape No. 4950. An adhesive coated side of the tape 70 adheres to a bottom surface 72 of the leg segment 30 while a second coated side adheres to a surface 76 of the ski 10.

In the described orientation of the clip body 16 on the ski 70, the end segment 34 of the clip body 16 is positioned closer to the front end 67 of the ski 10 than is the opposite open end of the clip body. This orientation is advantageous in that any potential for escape of the support body ski pole 18, 19 from the clip body 16 resulting from a force applied by virtue of the weight of the ski on the ski pole support body 18 is avoided because the end segment 30 will entrap a ski pole support body 18, 19 in the clip body 16. This condition might exist should there be slippage for any reason. Such undesired slippage might occur for example when the user employs a support body which is marginally sized or undersized in cross section relative to the dimensions of a shaped segment 40, 54 so as to fail to tension the clip and to establish a sufficient resilient force between itself and the clip body. Additionally, the positioning in the clip body 16 of the ski pole support body 18, 19 along its length and between the ski pole handle and basket segments 22 and 24 respectively, in combination with the basket 24 of the ski pole support body inhibits escape of the ski pole support body in the direction of a longitudinal axis 45 of the ski pole support body. In such case, the basket 24 will engage a side of the ski and inhibit further longitudinal movement.

In a particular construction of the clip body 16 which is not deemed to be limiting of the invention in any respect, clip body 16 is formed of a glass fiber reinforced nylon and has a length L of 2 inches, a width D of 1.5 inches and a thickness D of 0.125 inches.

Figure 9:
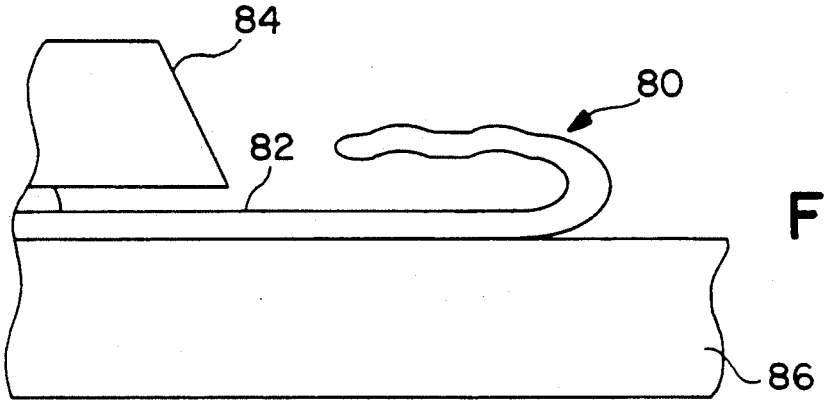
FIG. 9 is a fragmentary side elevation view illustrating an alternative embodiment of the invention.

FIG. 9 illustrates an alternative embodiment of the invention wherein the clip body 80 is integrally formed with a plate member 82 of a ski boot toe binding assembly 84. Mounting of the clip binding 80 to the ski 86 is accomplished upon mounting of the plate member 82 to the ski.

Figure 10:
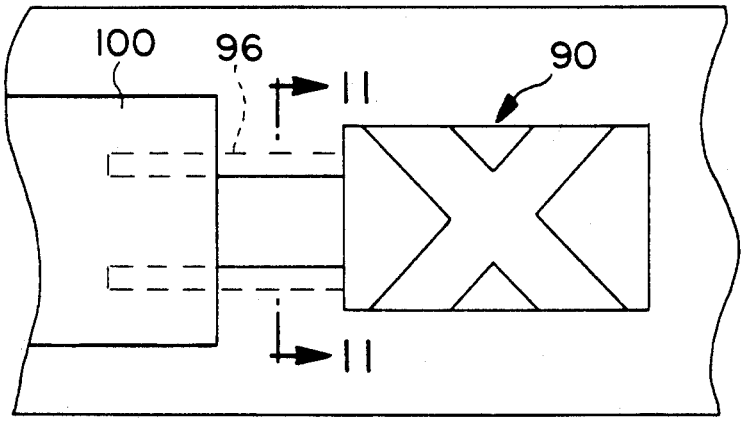
FIG. 10 is a fragmentary plan view of a further alternative embodiment of the invention; and, FIG. 11 is a view taken along line 11—11 of FIG. 10.
Figure 11:
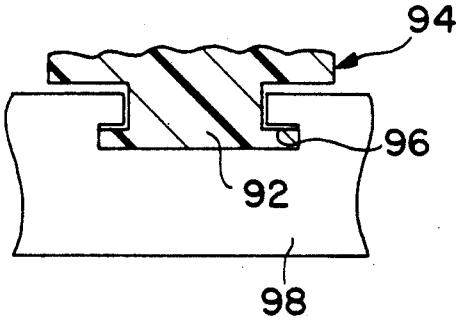

A further embodiment of the invention is illustrated in FIGS. 10 and 11. In this arrangement, the clip body 90 includes a foot segment 92 extending from a first leg member 94 of the clip body 90. Foot segment 92 is positioned in sliding engagement with a groove 96 formed in the ski 98. Sliding engagement enables the clip body 90 to be advanced away from and to withdraw to a position adjacent to a ski boot toe binding 100.

Thus, an improved snow ski support and transport arrangement has been described which utilizes a ski pole as a convenient facility in supporting the ski on a user's shoulder. The support arrangement includes a clip body mounted to a snow ski for receiving and captivating the support body ski pole. The support body can be carried at a preferred orientation for orientating the skis being transported with the ground. The clip body is adapted to be mounted on each ski and to receive the ski pole support body.

While there has been described a particular embodiment of the invention, it will be apparent to those skilled in the art that variations may be made thereto without departing from the spirit of the invention and the scope of the appended claims.

What is claimed is:

1. The combination comprising:

a) a generally U-shaped clip body having a longitudinal axis;

b) said U-shaped clip body having an integral end member and first and second integral leg members extending from the end member;

c) an elongated snow ski having a longitudinal axis:

d) said U-shaped clip body formed of a material and configured to provide for resilient deflection of said first and second leg members for receiving, positioning and captivating an elongated single, snow ski support body therebetween in a direction transverse to the longitudinal axis of said U-shaped clip body; and e) means for mounting said U-shaped clip body to said snow ski at said first leg member for providing that the longitudinal axis of said U-shaped clip body extends generally parallel to said longitudinal axis of said snow ski.

2. The combination of claim 1 wherein said U-shaped clip body has first and second sides thereof, the elongated snow ski support body is extendable into said U-shaped clip body between said first and second leg members at said first side from a location without the U-shaped clip body and extends from said U-shaped clip body at said second side.

3. The combination of claim 2 wherein said snow ski support body has a cross sectional configuration thereof and said second leg member includes a first shaped segment which is shaped to conform in part with said snow ski support body's cross sectional configuration.

4. The combination of claim 3 wherein said first shaped segment has a longitudinal axis thereof and the axis of said first shaped segment extends transverse to said longitudinal axis of said U-shaped clip body.

5. The combination of claim 4 wherein said first shaped segment is arcuate shaped to conform in part with the cross sectional configuration of a circular, tubular ski support body.

6. The combination of claim 4 including a second shaped segment formed in said second leg member, said second shaped segment shaped to conform in part with said snow ski support body's cross sectional configuration, said second shaped segment having a longitudinal axis thereof and said axis of said second shaped segment extends transverse to said longitudinal axis of said U-shaped clip body.

7. The combination of claim 3 wherein said snow ski support body comprises a ski pole having a basket which inhibits escape from said U-shaped clip.

8. The combination comprising:

a) an elongated snow ski having a longitudinal axis;

b) a ski pole;

c) a generally U-shaped clip body;

d) means for mounting said U-shaped clip body to said snow ski;

e) said U-shaped clip body having first and second resiliently deflectable leg members thereof;

f) said U-shaped clip body adapted for demountably receiving, positioning and captivating a single ski pole between said resilient leg members for providing that said ski pole extends in a direction transverse to said snow ski's longitudinal axis; and, g) said ski pole extending from a position without said clip body, into and between said resiliently deflectable leg members and from said clip body.

9. The combination of claim 4 wherein said U-shaped clip body has first and second sides thereof, said first shaped segment has a length thereof and said length extends between said first and second sides of said clip body.

10. The combination of claim 8 wherein said ski pole is elongated and includes a handle segment at a first end of said ski pole, said ski pole includes a second opposite distal end thereof, a ski pole basket positioned near said second distal end, and a segment of said ski pole along its length between said basket and handle extends between said first and second leg members of said U-shaped clip body.

11. The combination of claim 8 wherein said U-shaped clip body has a longitudinal axis, said snow ski has a longitudinal axis and said U-shaped clip body's longitudinal axis extends in a direction generally parallel to said longitudinal axis of said snow ski.

12. The combination of claim 8 wherein said U-shaped clip body is formed as an integral part of a ski boot binding.

13. The combination of claim 12 wherein said ski binding includes a plate thereof mounted to said ski and said first leg member of said U-shaped clip body is integrally formed with said plate.

14. The combination of claim 8 wherein said U-shaped clip body is mounted in a manner for advancing the clip body away from and withdrawing the clip body toward a ski binding member.

15. An improved clip body for supporting a snow ski, comprising:

a) a generally U-shaped clip body;

b) said U-shaped clip body having an integral end member and first and second integral leg members extending from the end member;

c) said U-shaped clip body having first and second sides thereof;

d) said U-shaped clip body formed of a material and configured to provide for resilient deflection of said first and second leg members for receiving and captivating therebetween an elongated, tubular snow ski support body having a circular shaped cross sectional configuration, the elongated snow ski support body extendable into said U-shaped clip body between said first and second leg members at said first side from a location without the clip and extends from said clip body at said second side;

e) said second leg member of said U-shaped clip body including a first arcuate shaped segment conforming in part with said ski support body's circular cross sectional configuration.

f) said U-shaped clip body having a longitudinal axis;

g) said first arcuate shaped segment having a longitudinal axis thereof which extends in a direction transverse to said longitudinal axis of said U-shaped clip body.

h) a second arcuate shaped segment formed in said second leg member of said U-shaped clip body, said second arcuate shaped segment conforming in part with the snow ski support body's circular cross sectional configuration;

i) said second arcuate shaped segment having a longitudinal axis thereof which extends in a direction transverse to said longitudinal axis of said U-shaped clip body;

j) said longitudinal axes of said first and second arcuate shaped segments intersect; and k) means for mounting said U-shaped clip body to a ski at said first leg member.

16. The combination of claim 15 wherein the longitudinal axes of said first and second shaped segments intersect to form an angle $\theta$ in the range of about 55 to 65 degrees.

17. The combination of claim 15 wherein said ski has opposite forward and rearward distal ends and said U-shaped clip body is mounted to said ski for providing that said integral end member of said U-shaped clip body is positioned at a location closer to said forward distal end than are said leg segments.

18. An improved combination comprising:

a) an elongated snow ski;

b) a ski pole;

c) a U-shaped clip body;

d) a ski boot binding member;

e) said U-shaped clip body having first and second resiliently deflectable leg members;

f) means for mounting said U-shaped clip body to say snow ski in a manner for advancing said U-shaped clip body away from and withdrawing the U-shaped clip body toward said ski boot binding member, said mounting means comprising a groove formed in said ski and a foot segment formed in and extending from said first leg member and positioned in said groove for sliding engagement therein;

g) said U-shaped clip body adapted for demountably receiving and captivating said ski pole between said resilient leg members; and, g) said ski pole extending from a position without said clip body, into and between said resiliently deflectable leg members and from said U-shaped clip body.

* * * * *